US011236719B2

(12) United States Patent
Kawakami et al.

(10) Patent No.: US 11,236,719 B2
(45) Date of Patent: Feb. 1, 2022

(54) INTERNAL COMBUSTION ENGINE

(71) Applicant: TOYOTA JIDOSHA KABUSHIKI KAISHA, Aichi-ken (JP)

(72) Inventors: Jun Kawakami, Gotemba (JP); Koji Kitano, Susono (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/699,733

(22) Filed: Dec. 2, 2019

(65) Prior Publication Data

US 2020/0208601 A1 Jul. 2, 2020

(30) Foreign Application Priority Data

Dec. 26, 2018 (JP) ..... JP2018-242548

(51) Int. Cl.
*F02P 19/02* (2006.01)
*F02M 61/18* (2006.01)
*F23Q 7/00* (2006.01)

(52) U.S. Cl.
CPC ..... *F02P 19/02* (2013.01); *F02M 61/1806* (2013.01); *F23Q 7/001* (2013.01)

(58) Field of Classification Search
CPC ..... F02P 19/02; F02M 61/1806; F23Q 7/001
USPC ..... 123/274
See application file for complete search history.

(56) References Cited

U.S. PATENT DOCUMENTS 4,177,948 A * 12/1979 Schaffitz ..... F02M 61/1806 239/533.3
4,595,144 A * 6/1986 Wiegand ..... F02M 61/182 239/533.3
4,627,405 A * 12/1986 Imhof ..... F02M 53/06 123/179.21
9,587,606 B2 * 3/2017 Anders ..... F02M 61/1833
10,012,196 B1 * 7/2018 Qi ..... F02B 23/0651
10,060,334 B2 * 8/2018 Polonowski ..... F02B 19/108
10,138,855 B2 * 11/2018 Mueller ..... F02B 23/0651
10,161,626 B2 * 12/2018 Mueller ..... F02B 23/0651
10,544,726 B2 * 1/2020 Kurtz ..... F02D 41/1439
2010/0122975 A1 * 5/2010 Burrows ..... F23Q 7/001 219/267
2012/0186555 A1 * 7/2012 Mueller ..... F02F 3/28 123/294
2013/0081598 A1 * 4/2013 Beltran Corona ... F02M 69/044 123/470

(Continued)

FOREIGN PATENT DOCUMENTS

JP H4109070 A 4/1992
JP H6-241050 A 8/1994

*Primary Examiner* — David Hamaoui
*Assistant Examiner* — John D Bailey
(74) *Attorney, Agent, or Firm* — Hauptman Ham, LLP

(57) ABSTRACT

A compressed self-ignition type internal combustion engine includes a fuel injection nozzle provided such that a plurality of injection holes are exposed from a cylinder head of the internal combustion engine to a combustion chamber, and a plurality of hollow ducts configured such that an inlet and an outlet are exposed to the combustion chamber. The plurality of ducts are configured such that each fuel spray injected from the plurality of injection holes of the fuel injection nozzle passes from the inlet to the outlet. The internal combustion engine includes a heating device for heating at least one of the plurality of ducts.

4 Claims, 11 Drawing Sheets

(56) References Cited

U.S. PATENT DOCUMENTS

| | | | | |
|---|---|---|---|---|
| 2015/0337793 | A1* | 11/2015 | Storm | F02P 19/025 123/65 R |
| 2016/0017836 | A1* | 1/2016 | Tanaka | F02D 35/023 701/104 |
| 2016/0097360 | A1* | 4/2016 | Mueller | F02M 61/1813 123/294 |
| 2016/0230653 | A1* | 8/2016 | Sher | F02B 51/02 |
| 2016/0298529 | A1* | 10/2016 | Anders | F02B 23/0627 |
| 2016/0298531 | A1* | 10/2016 | Anders | F02B 23/00 |
| 2016/0298584 | A1* | 10/2016 | Svensson | F02B 23/0651 |
| 2017/0009712 | A1* | 1/2017 | Svensson | F01P 3/02 |
| 2017/0074228 | A1* | 3/2017 | Takeuchi | H05B 3/48 |
| 2017/0089310 | A1* | 3/2017 | Svensson | F02M 55/00 |
| 2017/0114763 | A1* | 4/2017 | Mueller | F02P 23/04 |
| 2017/0114998 | A1* | 4/2017 | Mueller | F23D 11/383 |
| 2017/0350308 | A1 | 12/2017 | Polonowski et al. | |
| 2019/0063391 | A1* | 2/2019 | Martin | F02F 1/40 |
| 2019/0136745 | A1* | 5/2019 | Kurtz | F02M 26/06 |
| 2019/0277185 | A1* | 9/2019 | Hashizume | F02B 23/0669 |

* cited by examiner

INTERNAL COMBUSTION ENGINE

CROSS-REFERENCE TO RELATED APPLICATION

The present application is based on, and claims priority from, Japanese Patent Application Serial Number 2018-242548, filed on Dec. 26, 2018, the disclosure of which is hereby incorporated by reference herein in its entirety.

FIELD

A present disclosure relates to an internal combustion engine, and more particularly, to a compressed self-ignition type internal combustion engine which performs combustion by directly injecting fuel into a compressed combustion chamber. Background.

BACKGROUND

For example, US2017/0114763A discloses a technique for promoting premixing of fuel and charge air in a combustion chamber of a compressed self-ignition type internal combustion engine. In this technique, a duct constituted by a hollow tube is provided in the vicinity of an opening of a distal end portion of a fuel injection device exposed to a combustion chamber. The fuel injected from the opening is injected into the combustion chamber through the hollow tube. Inside the hollow tube, premixing with the filling air is promoted during the passage of the injected fuel. In this technique, a glow plug for assisting the ignition of the mixed gas of the fuel and the filling air is disposed on the downstream side of the duct. As a result, the ignitability of the mixed gas is improved.

SUMMARY

However, in the above technique, the mixed gas after passing through the duct is heated by the glow plug. The mixed gas after passing through the duct is susceptible to airflow in the combustion chamber. Therefore, in the above technique, heating of the mixed gas becomes insufficient, which may cause misfire.

The present disclosure has been made in view of the above-mentioned problems, and an object thereof is to provide a compressed self-ignition type internal combustion engine capable of suppressing the generation of smoke and improving ignitability.

In order to achieve the above object, a first disclosure is applied to a compressed self-ignition type internal combustion engine configured to perform combustion by injecting fuel into a compressed combustion chamber. The internal combustion engine includes a fuel injection nozzle having a plurality of injection holes for injecting fuel, and a plurality of hollow ducts configured to expose an inlet and an outlet to the combustion chamber. The fuel injection nozzle is provided so that a plurality of injection holes are exposed from the cylinder head of the internal combustion engine to the combustion chamber. The plurality of ducts are configured such that each fuel spray injected from the plurality of injection holes of the fuel injection nozzle passes from the inlet to the outlet. The internal combustion engine includes a heating device for heating at least one of the plurality of ducts.

A second disclosure has the following features in the first disclosure.

The plurality of ducts includes a first duct and a second duct having a duct length shorter than that of the first duct. The heating device is configured to heat the second duct.

A third disclosure has the following features in the first or second disclosure.

The plurality of ducts includes a small diameter duct and a large diameter duct having an inner diameter larger than that of the small diameter duct. The heating device is configured to heat the large diameter duct.

A fourth disclosure has the following features in any one of the first to third disclosures.

The plurality of ducts includes a low thermal conductivity duct and a high thermal conductivity duct having a higher thermal conductivity than the low thermal conductivity duct. The heating device is configured to heat the high thermal conductivity duct.

In order to achieve the above object, a fifth disclosure is applied to a compressed self-ignition type internal combustion engine configured to perform combustion by injecting fuel into a compressed combustion chamber. The internal combustion engine includes a fuel injection nozzle having a plurality of injection holes for injecting fuel, the plurality of injection holes being provided so as to be exposed from a cylinder head of the internal combustion engine to the combustion chamber; and a plurality of hollow ducts configured so that inlets and outlets are exposed to the combustion chamber. The plurality of ducts are configured such that each fuel spray injected from the plurality of injection holes of the fuel injection nozzle passes from the inlet to the outlet. The plurality of ducts are configured to include a low-ignitability duct having different ignition properties of the fuel spray that has passed therethrough and a high-ignitability duct. The internal combustion engine includes a heating device exposed at the outlet of the high-ignitability duct.

A sixth disclosure has the following features in the fifth disclosure.

The high-ignitability duct is configured to have a shorter duct length than the low-ignitability duct.

A seventh disclosure has the following features in the fifth or sixth disclosure.

The high-ignitability duct is configured to have a larger inner diameter than the low-ignitability duct.

An eighth disclosure has the following features in any one of the fifth to seventh disclosures.

The high-ignitability duct is configured to have a higher thermal conductivity than the low-ignitability duct.

In order to achieve the above object, a ninth disclosure is applied to a compressed self-ignition type internal combustion engine configured to perform combustion by injecting fuel into a compressed combustion chamber. The internal combustion engine includes a fuel injection nozzle and a hollow duct. The fuel injection nozzle has a plurality of injection holes for injecting fuel, and the injection holes is provided so as to be exposed from a cylinder head of the internal combustion engine to the combustion chamber. The duct is provided so that an inlet and an outlet are exposed to the combustion chamber and fuel spray injected from the injection holes of the fuel injection nozzle passes from the inlet to the outlet. The plurality of injection holes are provided so that each fuel spray is injected radially toward a bore wall surface of the combustion chamber. The duct is disposed corresponding to a part of the plurality of injection holes. The internal combustion engine includes a heating device for heating a fuel spray injected from an injection hole in which the duct is not arranged among the plurality of injection holes.

According to the first aspect of the present disclosure, the internal combustion engine includes the heating device for heating at least one of the plurality of ducts. As a result, the fuel spray passing through the duct may be heated by the inner wall surface of the duct. Thereby, premixing with the filling air is promoted while the fuel spray is heated, so that generation of smoke may be suppressed and ignitability may be improved.

The shorter the duct length, the smaller the effect of extending the ignition position. Therefore, the second duct has a higher ignition performance in the cold state of the internal combustion engine as compared with the first duct. According to the second aspect, the heating device is configured to heat the second duct. According to such a configuration, the ignitability of the second duct may be further improved. Thereby, simultaneous formation of spraying in which the ignition position is extended by passing through the first duct and spraying in which the ignitability is improved by passing through the second duct may be performed, and therefore, both suppression of smoke and improvement of ignitability may be achieved.

The larger the duct inner diameter, the smaller the effect of extending the ignition position. Therefore, the large diameter duct has a higher ignition performance in the cold state of the internal combustion engine as compared with the small diameter duct. According to the third aspect, the heating device is configured to heat the large diameter duct. According to such a configuration, the ignitability of the large diameter duct may be further improved. As a result, it is possible to simultaneously form the spray in which the ignition position is extended by passing through the small diameter duct and the spray in which the ignitability is improved by passing through the large diameter duct, so that both suppression of smoke and improvement of the ignitability may be achieved.

The higher the thermal conductivity of the duct, the smaller the effect of extending the ignition position. Therefore, the high thermal conductivity duct has a higher ignition performance in the cold state of the internal combustion engine as compared with the low thermal conductivity duct. According to a fourth aspect, the heating device is configured to heat the high thermal conductivity duct. According to such a configuration, the ignitability of the high thermal conductivity duct may be further improved. As a result, simultaneous formation of spraying in which the ignition position is extended by passing through the low thermal conductivity duct and spraying in which the ignitability is improved by passing through the high thermal conductivity duct is possible, so that both suppression of smoke and improvement of ignitability may be achieved.

According to a fifth aspect of the present disclosure, an internal combustion engine includes a heating device exposed at an outlet of a highly ignitable duct among a plurality of ducts. This makes it possible to heat the fuel spray that has passed through the highly ignitable duct. As a result, it is possible to simultaneously form the spray in which the ignition position is extended by passing through the low-ignitability duct and the spray in which the ignitability is improved by passing through the high-ignitability duct, so that both suppression of smoke and improvement of the ignitability may be achieved.

The shorter the duct length, the smaller the effect of extending the ignition position. Therefore, a second duct (i.e. the high-ignitability duct) having a duct length shorter than that of a first duct (i.e. the low-ignitability duct) has a higher ignitability of the internal combustion engine during cold operation than the first duct. According to the sixth aspect, the heating device is provided so as to be exposed at the outlet portion of the second duct. According to such a configuration, the ignitability of the fuel spray passing through the second duct may be further improved. Thereby, simultaneous formation of spraying in which the ignition position is extended by passing through the first duct and spraying in which the ignitability is improved by passing through the second duct may be performed, and therefore, both suppression of smoke and improvement of ignitability may be achieved.

The larger the duct inner diameter, the smaller the effect of extending the ignition position. Therefore, the large diameter duct (i.e. the high-ignitability duct) having an inner diameter larger than that of a small diameter duct (i.e. the low-ignitability duct) has a higher ignition performance in the cold state of the internal combustion engine as compared with the small diameter duct. According to the seventh aspect of the present disclosure, the heating device is provided so as to be exposed at the outlet portion of the large diameter duct. According to such a configuration, the ignitability of the large diameter duct may be further improved. As a result, it is possible to simultaneously form the spray in which the ignition position is extended by passing through the small diameter duct and the spray in which the ignitability is improved by passing through the large diameter duct, so that both suppression of smoke and improvement of the ignitability may be achieved.

The higher the thermal conductivity of the duct, the smaller the effect of extending the ignition position. Therefore, a high thermal conductivity duct (i.e. the high-ignitability duct) having a high thermal conductivity than a low thermal conductivity duct (i.e. the low-ignitability duct) has a higher ignition performance in the cold state of the internal combustion engine as compared with the low thermal conductivity duct. According to the eighth aspect of the present disclosure, the heating device is provided so as to be exposed at the outlet portion of the high thermal conductivity duct. According to such a configuration, the ignitability of the high thermal conductivity duct may be further improved. As a result, simultaneous formation of spraying in which the ignition position is extended by passing through the low thermal conductivity duct and spraying in which the ignitability is improved by passing through the high thermal conductivity duct is possible, so that both suppression of smoke and improvement of ignitability may be achieved.

The fuel spray that does not pass through the duct has a higher ignition performance in the cold state of the internal combustion engine as compared with the fuel spray that passes through the duct. According to the ninth aspect of the present disclosure, since the fuel spray that does not pass through the duct may be heated by the heating device, the ignitability of the fuel spray that does not pass through the duct may be further improved. As a result, it is possible to simultaneously form the spray in which the ignition position is extended by passing through the duct and the spray in which the ignitability is improved without passing through the duct, and therefore it is possible to achieve both suppression of smoke and improvement of the ignitability.

DETAILED DESCRIPTION

Hereinafter, embodiments of the present disclosure will be described with reference to the accompanying drawings. However, it is to be understood that even when the number, quantity, amount, range or other numerical attribute of each element is mentioned in the following description of the embodiments, the present disclosure is not limited to the mentioned numerical attribute unless explicitly described otherwise, or unless the present disclosure is explicitly specified by the numerical attribute theoretically. Furthermore, structures or steps or the like that are described in conjunction with the following embodiments are not necessarily essential to the present disclosure unless explicitly described otherwise, or unless the present disclosure is explicitly specified by the structures, steps or the like theoretically.

1. First Embodiment

First embodiment will be described with reference to the drawings.

1-1. Configuration of First Embodiment

Figure 1:
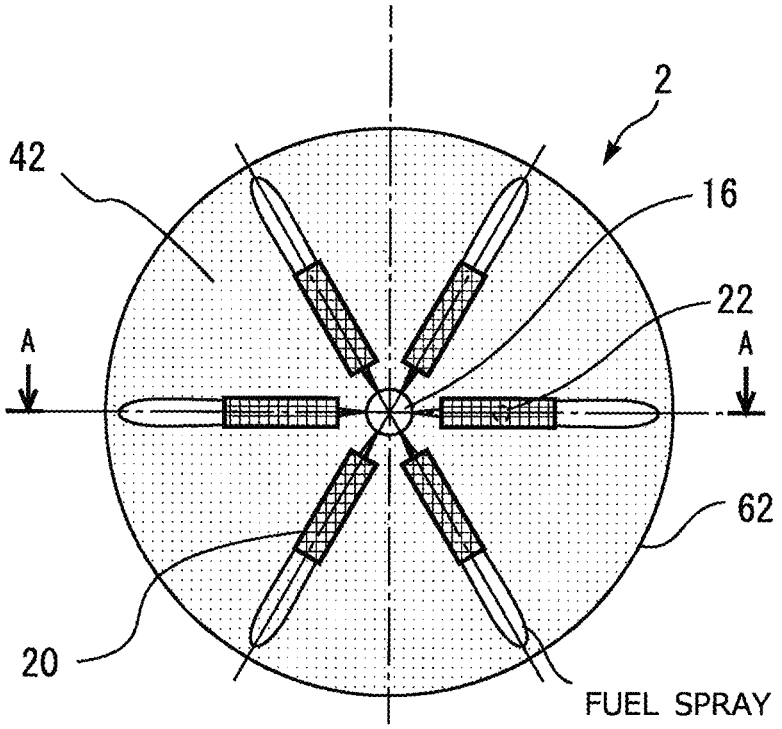
FIG. 1 is a schematic perspective view of an internal structure of a combustion chamber of an internal combustion engine according to first embodiment from a lower surface side.
Figure 2:
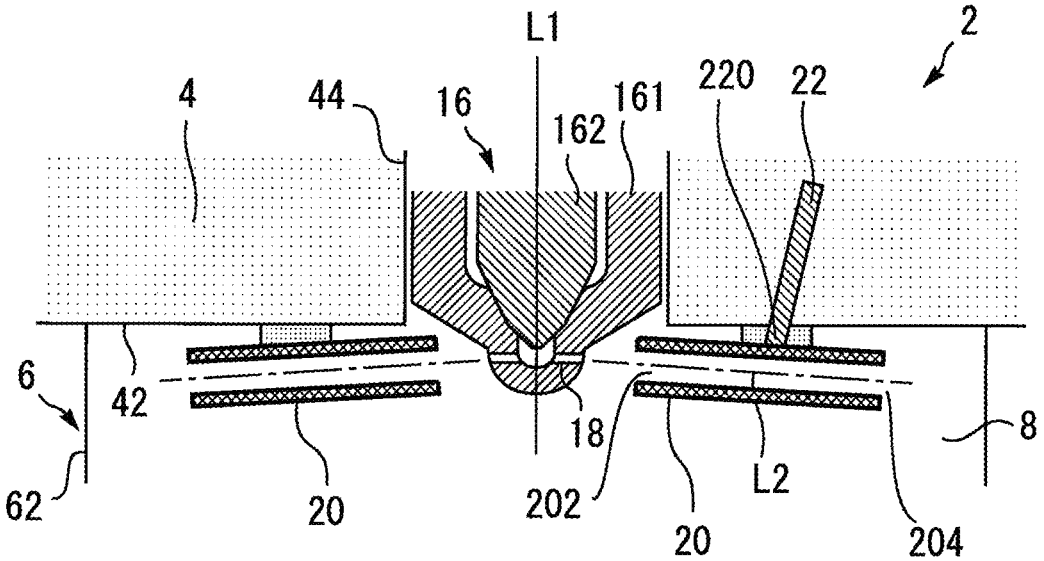
FIG. 2 is a schematic perspective view of the internal structure of the internal combustion engine shown in FIG. 1 taken along line A-A from the side.

FIG. 1 is a schematic perspective view of an internal structure of a combustion chamber of an internal combustion engine according to first embodiment from a lower surface side. FIG. 2 is a schematic perspective view of an internal structure of the internal combustion engine shown in FIG. 1, taken along line A-A. The internal combustion engine 2 according to the first embodiment is a compressed self-ignition type internal combustion engine (hereinafter, simply referred to as an "engine") having a plurality of cylinders. FIGS. 1 and 2 show the internal structure of one of a plurality of cylinders included in the engine 2.

As shown in FIGS. 1 and 2, the engine 2 includes a cylinder head 4 and a cylinder block 6. A cylinder bore 62 is formed in the cylinder block 6. A piston (not shown) is disposed inside the cylinder bore 62. A combustion chamber 8 is formed in a space surrounded by the cylinder head 4, the cylinder bore 62, and the top surface of the piston.

Two intake valves and two exhaust valves (not shown) are disposed on the top surface portion 42 of the cylinder head 4 forming the combustion chamber 8. The fuel injection nozzle 16 is disposed at the central of the top surface portion 42. More specifically, a mounting hole 44 for fixing the fuel injection nozzle 16 passes through the central of the top surface portion 42 with the cylinder center axis L1 as the center axis. The fuel injection nozzle 16 has a configuration in which a needle 162 is provided inside a body 161. The fuel injection nozzle 16 is provided with six injection holes 18 that are uniformly radially injected toward a bore wall surface of the combustion chamber 8. The fuel injection nozzle 16 is fixed to the mounting hole 44 so that the injection holes 18 at the tip end is exposed to the inside of the combustion chamber 8.

The engine 2 of the first embodiment includes a duct 20 fixed to the top surface portion 42 of the cylinder head 4. The duct 20 is constituted by a straight hollow tube passing from an inlet 202 to an outlet 204. The duct 20 is provided for each of the six injection holes 18 so that the center axis of the hollow tube coincides with the injection hole axis L2.

The engine 2 according to the first embodiment includes a glow plug 22 for heating the duct 20 as a characteristic configuration thereof. The glow plug 22 is an example of a heating device that heats the duct 20. The glow plug 22 is fixed to the cylinder head 4 so that, for example, a tip portion 220 of the glow plug 22, which is a heat generating portion, comes into contact with or comes close to the duct 20.

Figure 3:
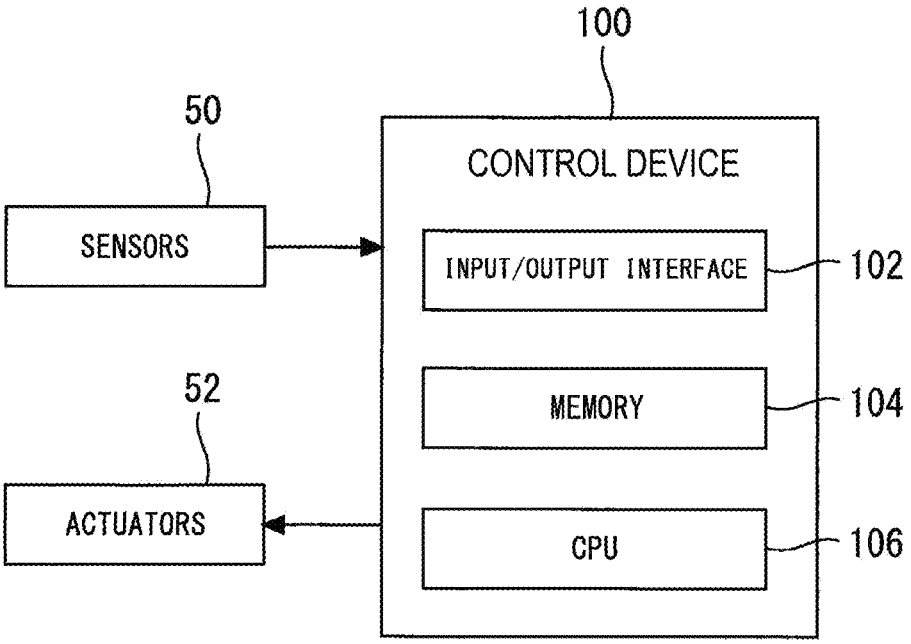
FIG. 3 is a diagram showing a schematic configuration of a control device included in the engine according to the first embodiment.

The engine 2 configured as described above is controlled by a control device (controller) 100. FIG. 3 is a diagram showing a schematic configuration of the control device included in the engine according to the first embodiment. The control device 100 is an Electronic Control Unit (ECU). A processing circuitry of the ECU 100 includes at least input/output interface 102, at least one memory 104, and at least one CPU 106. The input/output interface 102 is provided for receiving sensor signals from various sensors 50 installed in the engine and outputting operation signals to actuators provided in the internal combustion engine. The various sensors 50 that the ECU 100 takes in signals include various sensors required for controlling the engines, such as an air flow meter for measuring the flow rate of fresh air taken into an intake passage, a crank angle sensor for detecting the rotational angle of a crankshaft, and an accelerator position sensor for detecting the amount of depression of an accelerator pedal. The actuators 52 to which the ECU 100 outputs operating signals include various actuators such as the glow plug 22 described above. Various control programs, maps, and the like for controlling the internal combustion engine are stored in the memory 104. The CPU (processor) 106 reads out a control program or the like from a memory and executes the control program or the like, and generates an operation signal based on the received sensor signals.

Each function of the control device 100 is realized by software, firmware, or a combination of software and firmware. At least one of the software and the firmware is written as a program. At least one of software and firmware is stored in at least one memory 104. The at least one processor 106 realizes each function of the control device 100 by reading and executing a program stored in the at least one memory 104. The at least one processor 106 may also be referred to as a CPU (Central Processing Unit), a processor, a computing device, a microprocessor, a microcomputer, or a DSP (Digital Signal Processor). For example, the at least one memory 104 is a nonvolatile or volatile semiconductor memory such as RAM (Random Access Memory), ROM (Read Only Memory), flash memory, EPROM (Erasable Programmable Read Only Memory, or EEPROM (Electrically Erasable Programmable Read-Only Memory, a magnetic disk, a flexible disk, an optical disk.

Also, if the processing circuitry of the controller 100 includes at least one dedicated hardware, the processing circuitry may be, for example, a single circuit, a complex circuit, a programmed processor, a parallel programmed processor, a ASIC (Application Specific Integrated Circuit, a FPGA (Field-Programmable Gate Array, or combinations thereof. The functions of the respective units of the control device 100 may be realized by the processing circuitry. In addition, the functions of the respective units of the control device 100 may be realized collectively by the processing circuitry.

In addition, some of the functions of the control device 100 may be realized by dedicated hardware, and some of the other functions may be realized by software or firmware. In this manner, the processing circuitry realizes each function of the control device 100 by hardware, software, firmware, or a combination thereof.

1-2. Operation of First Embodiment

In the compressed self-ignition type engine 2, the fuel is injected from the fuel injection nozzle 16 in a state in which the air filled in the combustion chamber 8 is compressed. It is preferable that the injected fuel spray is mixed with the charge air to promote homogenization of the fuel concentration, and then combustion by self-ignition is performed. However, for example, in the configuration without the duct 20, the fuel spray injected from the fuel injection nozzle 16 may be overheated quickly by the heat of the combustion chamber 8, and may self-ignite before being sufficiently mixed with the charge air. In this case, the generation of smoke due to the combustion of the excess fuel and the reduction of the thermal efficiency due to the prolongation of the afterburn period become problems.

On the other hand, in the configuration including the duct 20, the fuel spray injected from the fuel injection nozzle 16 is introduced into the duct 20 from the inlet 202. Passing the fuel through the duct 20 provides a stronger penetration effect than if the fuel were not passed through the duct 20. This makes it possible to efficiently utilize the filling air in the vicinity of the bore wall surface of the combustion chamber 8.

As described above, according to the engine 2 of the first embodiment, the premixing of the fuel spray and the filling air may be promoted while suppressing the self-ignition in the process of the injected fuel spray passing through the duct 20. This makes it possible to suppress the generation of smoke due to self-ignition of the excess fuel before homogenization. Further, according to the engine 2 of the first embodiment, self-ignition during passage through the duct 20 is suppressed, so that the self-ignition timing may be delayed. As a result, the afterburn period is shortened, so that the thermal efficiency may be improved.

Here, the inventors of the present application have recognized the following problems with the above-mentioned duct 20. This means that, when the duct 20 is installed in the combustion chamber 8, the ignition position is extended toward the wall surface of the bore of the combustion chamber 8 even under operating conditions in which the ignitability is lowered, such as at a low outside air temperature or in the cold state of the engine 2. As a result, when the engine 2 is cold or the like, the fuel spray may collide with the bore wall surface before ignition, causing an increase in HC or misfire.

Figure 4:
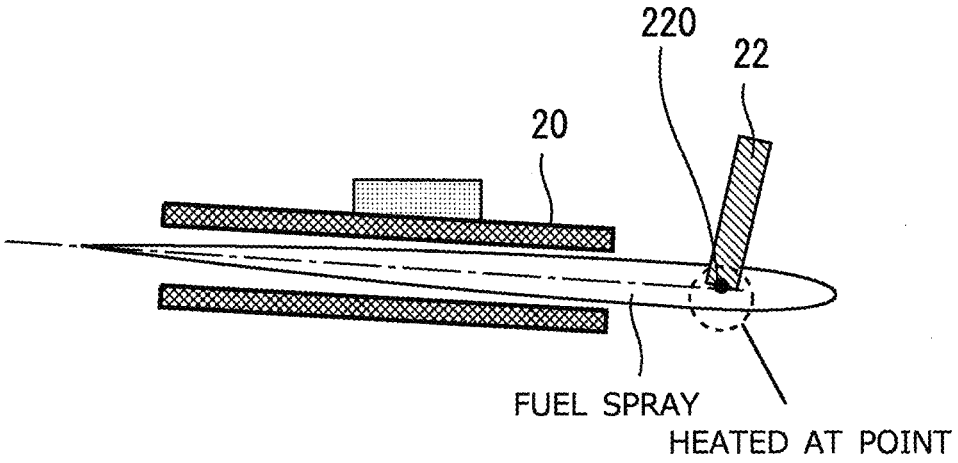
FIG. 4 is a schematic diagram for explaining a layout of a glow plug of an engine of a comparative example.

The inventors of the present application has focused on a configuration in which ignitability is improved by using a heating device such as a glow plug. FIG. 4 is a schematic diagram for explaining the layout of the glow plug of the engine of the comparative example. In the engine of the comparative example shown in FIG. 4, elements common to those of the engine of the first embodiment are denoted by the same reference numerals. In the engine of the comparative example shown in FIG. 4, the glow plug 22 is disposed in a space on the downstream side of the duct 20 so that the tip portion 220, which is a heat generating portion, is exposed. According to such an arrangement, the fuel spray diffused from the outlet 204 through the duct 20 may be heated by the heat generating portion at the tip of the glow plug 22.

However, the engine of this comparative example has the following problems. That is, the fuel spray passing through the duct is "heated at the point" by the tip portion 220 of the glow plug 22. In such a configuration, it is not possible to heat the entire fuel spray that has passed through the duct, and therefore, there still remains a problem of an increase in HC and misfire.

Figure 5:
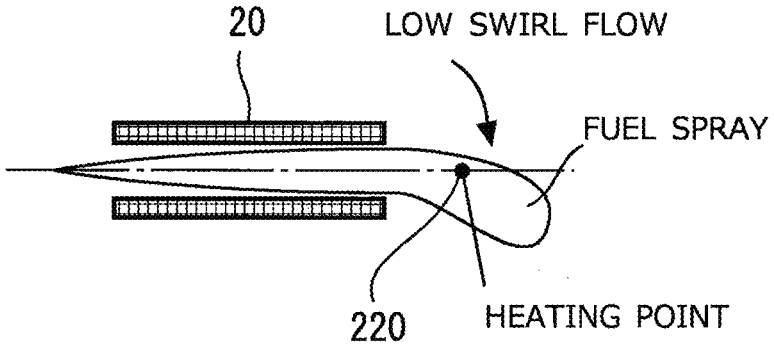
FIG. 5 is a schematic perspective view of the influence of the air flow in a combustion chamber at the time of the low rotation speed of the engine of the comparative example shown in FIG. 4 from the lower surface side.
Figure 6:
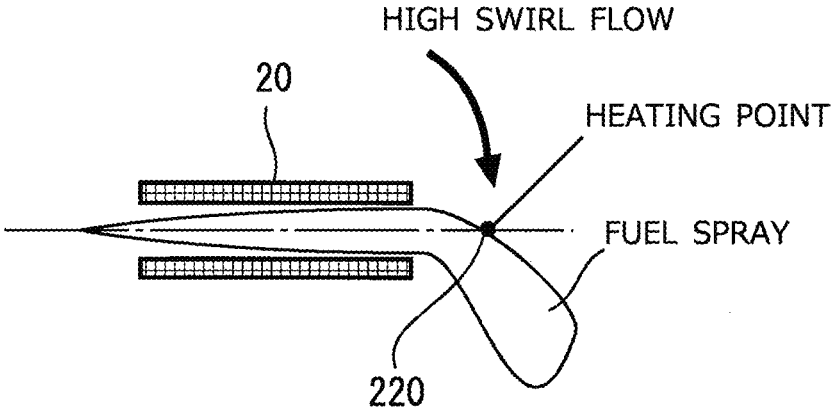
FIG. 6 is a schematic perspective view of the influence of the air flow in the combustion chamber at the time of the high rotation speed of the engine of the comparative example shown in FIG. 4 from the lower surface side.

Further, the layout of the glow plug 22 of the comparative example has a problem from the viewpoint of the air flow in the combustion chamber. FIG. 5 is a schematic perspective view of the influence of the air flow in the combustion chamber at the time of the low rotation speed of the engine of the comparative example shown in FIG. 4 from the lower surface side. FIG. 6 is a schematic perspective view of the influence of the air flow in the combustion chamber at the time of the high rotation speed of the engine of the comparative example shown in FIG. 4 from the lower surface side. In the engines of the comparative examples shown in these drawings, elements common to those of the engines of the first embodiment are denoted by the same reference numerals. As shown in FIG. 5, for example, a relatively weak low swirl flow may be generated at the low rotation speed of the engine. In this case, the fuel spray passing through the duct 20 receives the low swirl flow and is flowed to the downstream side of the air flow. As shown in FIG. 6, for example, a relatively strong high swirl flow may be generated at the high rotation speed of the engine. In this case, the fuel spray passing through the duct 20 receives the high swirl flow and is largely flowed to the downstream side of the air flow.

In this manner, the fuel spray having passed through the duct 20 is caused to flow to the downstream side of the airflow under the influence of the swirl flow. Therefore, as shown in these drawings, the positional relationship between the fuel spray and the heating point by the glow plug changes in accordance with the operating conditions of the engine. Therefore, in order to optimize the positional relationship between the fuel spray and the heating point by the glow plug 22 under various operating conditions, it is required to adapt the injection pressure, the injection timing, and the like of the fuel for each operating condition.

As described above, in the engine of the comparative example in which the glow plug 22 is disposed on the downstream side of the duct 20, there is a problem in that the ignitability of the fuel spray passing through the duct 20 is improved.

Figure 7:
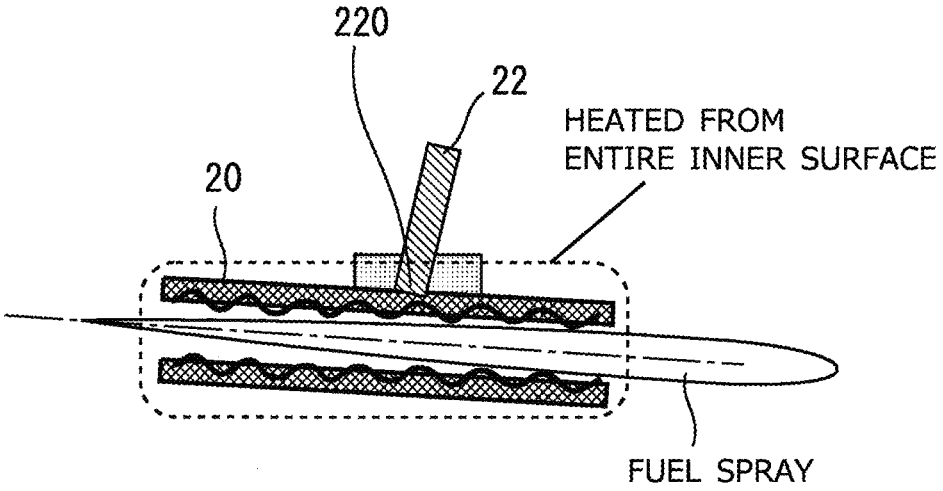
FIG. 7 is a schematic diagram for explaining the layout of a glow plug in the engine according to the first embodiment.

FIG. 7 is a schematic diagram for explaining the layout of the glow plugs of the engine according to the first embodiment. As shown in FIG. 7, in the engine 2 of the first embodiment, the glow plug 22 is fixed to the cylinder head 4 so that the heating portion of the tip comes into contact with or comes close to the duct 20. According to such a configuration, the heat of the tip portion 220 of the glow plug 22 is transferred to the entire duct 20. As a result, the fuel spray passing through the duct 20 is heated from the entire inner wall surface of the duct 20. Thereby, the heat reception from the glow plug 22 to the fuel spray is promoted, so that the ignitability of the fuel spray may be effectively improved.

Figure 8:
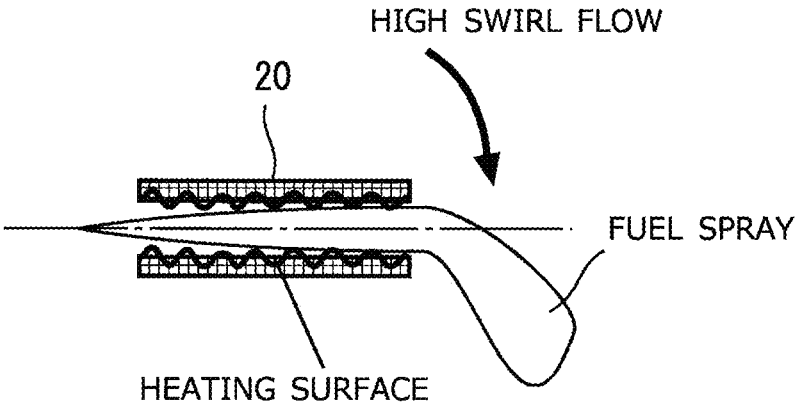
FIG. 8 is a view schematically showing the influence of the air flow in the combustion chamber at the time of high rotation speed of the engine according to the first embodiment from the lower surface side.

FIG. 8 is a schematic perspective view of the influence of the air flow in the combustion chamber at the time of the high rotation speed of the engine of the first embodiment from the lower surface side. As shown in FIG. 8, according to the engine 2 of the first embodiment, the fuel spray is heated in the process of passing through the duct 20. This makes it possible to heat the fuel spray before it is influenced by the swirl flow, so that it is possible to realize stable heating of the fuel spray regardless of the operating conditions.

As described above, according to the engine 2 of the first embodiment, stable heating of the fuel spray becomes possible, and therefore, it becomes possible to effectively suppress the increase of HC and the occurrence of misfire.

1-3. Modification of First Embodiment

The engine 2 of the first embodiment may adopt a modified form as described below.

The configuration of the duct 20 is not limited to the shape, number, or the like as long as the configuration is such that the fuel spray injected from the injection holes 18 of the fuel injection nozzle 16 passes from the inlet 202 to the outlet 204. For example, an annular member in which a plurality of cylindrical ducts 20 are formed may be attached to the top surface portion 42 of the cylinder head 4.

The control device 100 may be configured to control the energization state of the glow plug 22 in accordance with the operating condition of the engine 2. For example, the control device 100 may be configured to specify a period during which the engine 2 is cold or at a low outside air temperature based on the detection values of the various sensors 50, and to energize the glow plug 22 only during that period. As a result, unnecessary power consumption may be suppressed, and thus energy efficiency may be improved. This modification example may also be applied to the engine 2 of the second embodiment, which will be described later.

The glow plug 22 may not be provided in all of the plurality of ducts 20. That is, the glow plug 22 may be provided corresponding to at least one duct 20 among the plurality of ducts 20. This makes it possible to achieve both improvement in ignitability and improvement in energy efficiency. This modification may also be applied to an engine of another embodiment to be described later.

The heating device for heating the duct 20 is not limited to the glow plug 22. That is, the heating device may be, for example, a hot wire disposed in contact with or in close proximity to the periphery of the duct 20, as long as the duct 20 may be directly heated. This modification may also be applied to an engine of another embodiment to be described later.

2. Second Embodiment

Second embodiment will be described with reference to the drawings.

2-1. Configuration of Second Embodiment

Figure 9:
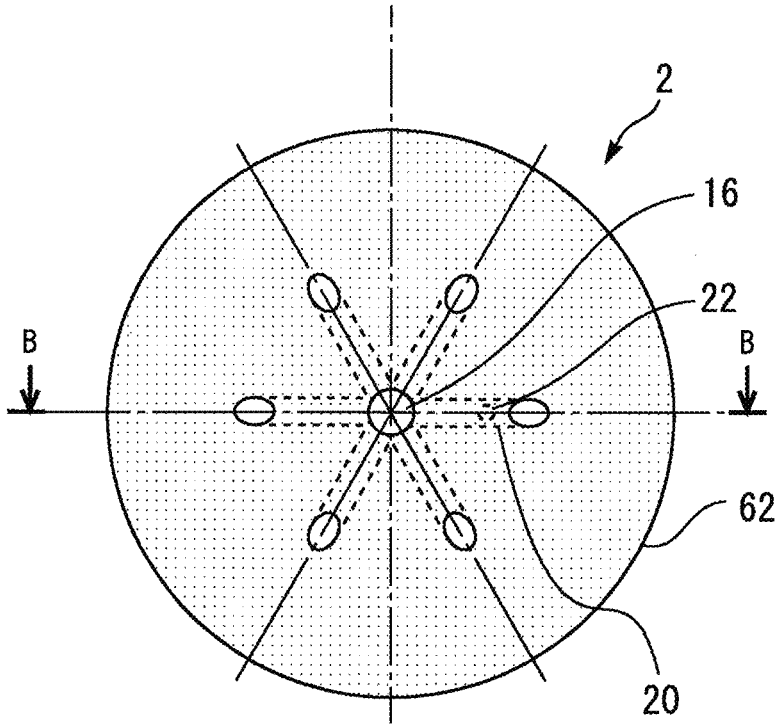
FIG. 9 is a schematic perspective view of an internal structure of a combustion chamber of an engine according to second embodiment from the lower surface side.
Figure 10:
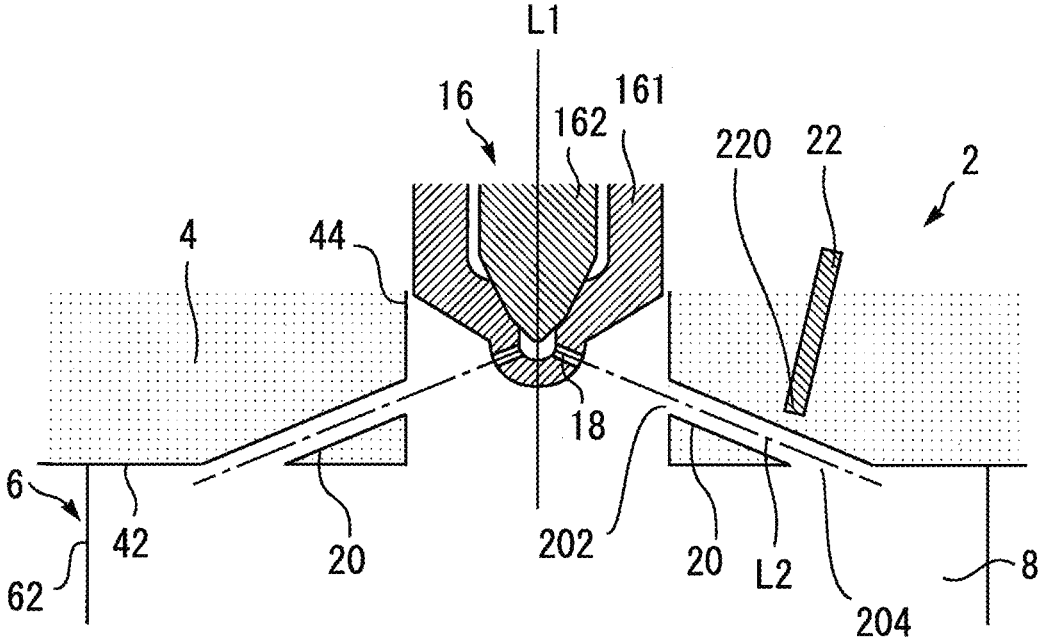
FIG. 10 is a schematic perspective view of the internal structure of the engine shown in FIG. 9 taken along line B-B from the side surface side.

FIG. 9 is a schematic perspective view of an internal structure of the combustion chamber of the engine according to the second embodiment from the lower surface side. FIG. 10 is a schematic perspective view of the internal structure of the engine in FIG. 9, cut along line B-B, from the side surface side. In FIGS. 9 and 10, elements common to those in FIG. 1 or 2 are denoted by the same reference numerals, and detailed description thereof is omitted.

As shown in FIGS. 9 and 10, in the engine 2 according to the second embodiment, the duct 20 is configured inside the cylinder head 4. More specifically, the duct 20 is formed by a straight through hole that penetrates the interior of the cylinder head 4 from the inlet 202 provided on the side surface of the mounting hole 44 toward the outlet 204 provided on the top surface portion 42. The duct 20 is configured so that the central axis of the through hole coincides with the injection hole axis L2. In the engine 2 of the second embodiment, the respective ducts 20 are provided with respect to the injection hole axes L2 of the six injection holes 18.

At least one of the plurality of ducts 20 is provided with a glow plug 22. The glow plug 22 is fixed to the cylinder head 4 so that the tip portion 220 of the glow plug 22, which is, for example, a heat generating portion, comes into contact with or comes close to the duct 20.

2-2. Operation of Embodiment 2

In the engine 2 of the second embodiment, the duct 20 formed inside the cylinder head 4 may be heated by the glow plug 22. The fuel spray passing through the duct 20 heats from the entire inner wall surface of the duct 20. As a result, the reception of heat from the glow plug 22 to the fuel spray is promoted, so that the ignitability of the fuel spray at the time of cooling of the engine 2 may be effectively improved.

Further, in the engine 2 of the second embodiment, since the duct 20 is formed inside the cylinder head 4, it is possible to improve the ignitability of the fuel spray in the cold state of the engine 2 while reducing the number of parts.

2-3. Modification of Second Embodiment

The engine 2 of the second embodiment may adopt a modified form as described below.

Figure 11:
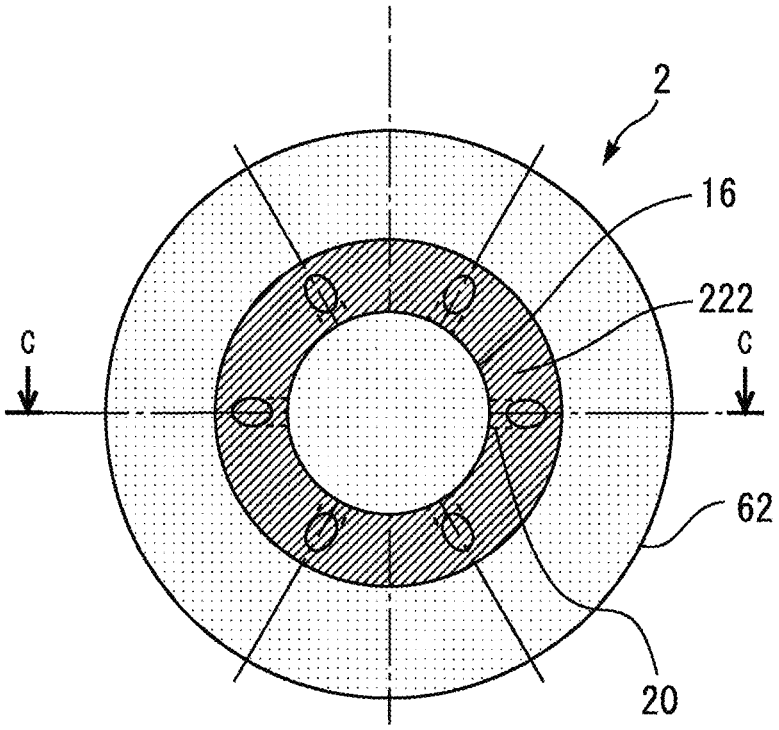
FIG. 11 is a schematic perspective view of an internal structure of a combustion chamber of an engine according to a modification of the second embodiment from a lower surface side.
Figure 12:
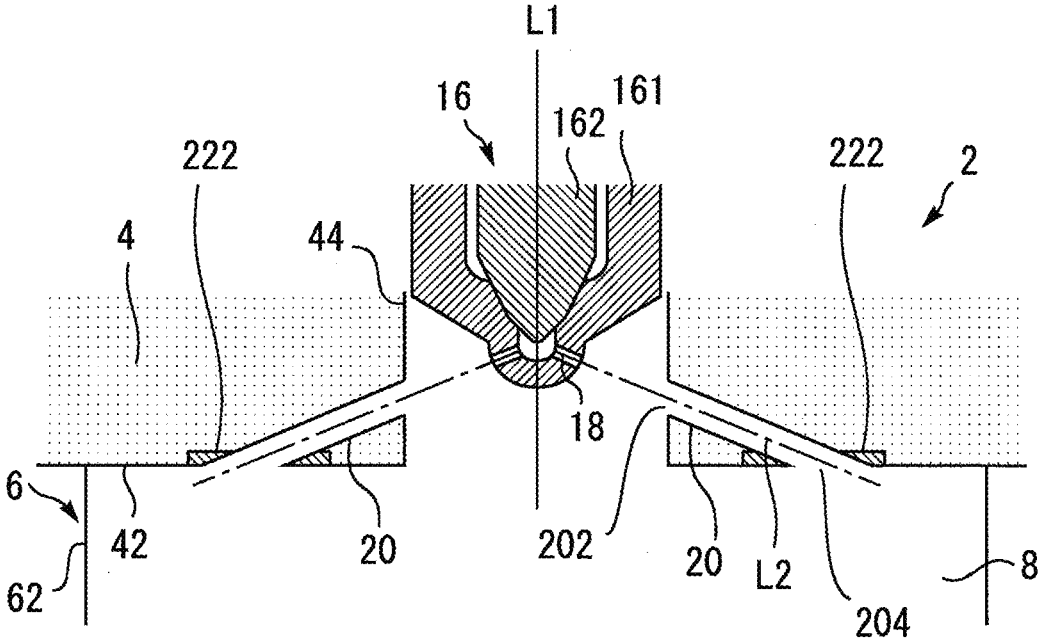
FIG. 12 is a schematic perspective view of the internal structure of the engine in FIG. 11, taken along line C-C, from the side surface side.

The heating device for heating the duct 20 is not limited to the glow plug 22. FIG. 11 is a schematic perspective view of an internal structure of a combustion chamber of an engine according to a modification of the second embodiment from a lower surface side. FIG. 12 is a schematic perspective view of the internal structure of the engine in FIG. 11, taken along line C-C, from the side surface side. In FIGS. 11 and 12, elements common to those in FIG. 1 or 2 are denoted by the same reference numerals, and detailed description thereof is omitted.

As shown in FIGS. 11 and 12, the heating device may be configured as, for example, an annular heating element 222 provided on the top surface portion 42 of the duct 20, as long as the heating device may directly heat the duct 20. The heating element 222 is configured as a heater that generates heat by being energized. The heating element 222 is controlled by the control device 100. For example, the heating element 222 heats the outlet 204 of the duct 20 to 350° C. or more during the preheating period at the time of starting. According to such a configuration, the deposit adhering to the duct 20 may be burned, and the ignitability of the fuel spray in the cold time of the engine 2 may be effectively improved.

3. Third Embodiment

Third embodiment will be described with reference to the drawings.

3-1. Configuration of Third Embodiment

Figure 13:
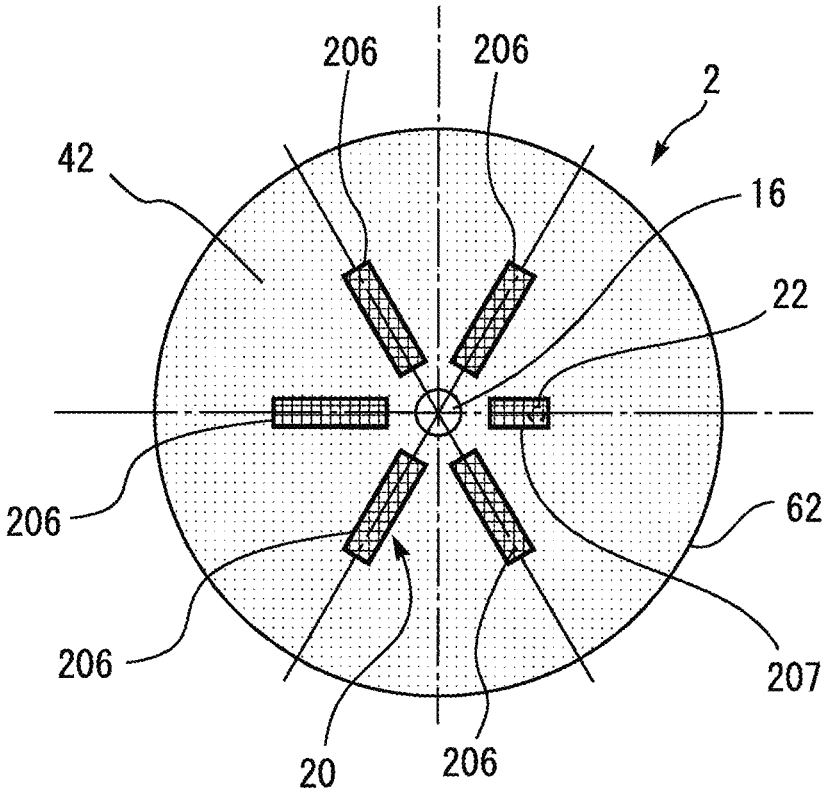
FIG. 13 is a schematic perspective view of an internal structure of a combustion chamber of an engine according to the third embodiment from the lower surface side.

FIG. 13 is a schematic perspective view of an internal structure of a combustion chamber of an engine according to the third embodiment from the lower surface side. In FIG. 13, elements shared with those in FIG. 1 are denoted by the same reference numerals, and detailed description thereof is omitted.

As shown in FIG. 13, in the engine 2 according to the third embodiment, the plurality of ducts 20 includes a plurality of first ducts 206 and a single second duct 207. The second duct 207 is configured to have a shorter duct length than the first duct 206. The glow plug 22 is provided corresponding to the second duct 207.

3-2. Features of Third Embodiment

The shorter the duct length, the smaller the effect of extending the ignition position. Therefore, the second duct 207 has a higher ignition performance in the cold state of the engine 2 as compared with the first duct 206. According to the engine 2 of the third embodiment, since the glow plug 22 is provided corresponding to the second duct 207, the ignitability of the second duct 207 may be further improved. Thereby, simultaneous formation of spraying in which the ignition position is extended by passing through the first duct 206 and spraying in which the ignitability is improved by passing through the second duct 207 is possible, so that both suppression of smoke and improvement of ignitability may be achieved.

3-3. Modification of Third Embodiment

The engine 2 of the third embodiment may adopt a modified form as described below.

A plurality of second ducts 207 may be provided. In this case, the glow plug 22 may be provided corresponding to at least one of the plurality of second ducts 207.

Figure 14:
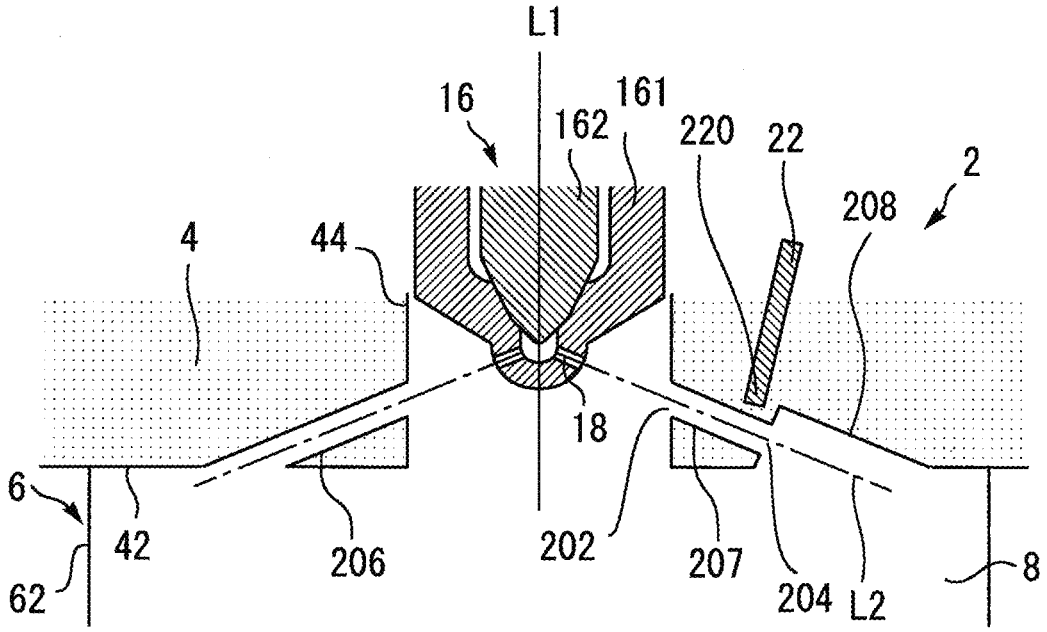
FIG. 14 is a schematic perspective view of the internal structure of an engine as a modification of the third embodiment from the side surface side.

The second duct 207 and the first duct 206 may be configured as a through hole formed inside the cylinder head 4. FIG. 14 is a schematic perspective view of the internal structure of an engine as a modification of the third embodiment from the side surface side. As shown in FIG. 14, the second duct 207 and the first duct 206 are configured as through holes in the interior of the cylinder head 4. The second duct 207 has a shorter duct length than the first duct 206 by processing a counterbore 208 from the top surface portion 42 side. With such a configuration, the second duct 207 and the first duct 206 may also be formed.

4. Fourth Embodiment

Fourth embodiment will be described with reference to the drawings.

4-1. Configuration of Fourth Embodiment

Figure 15:
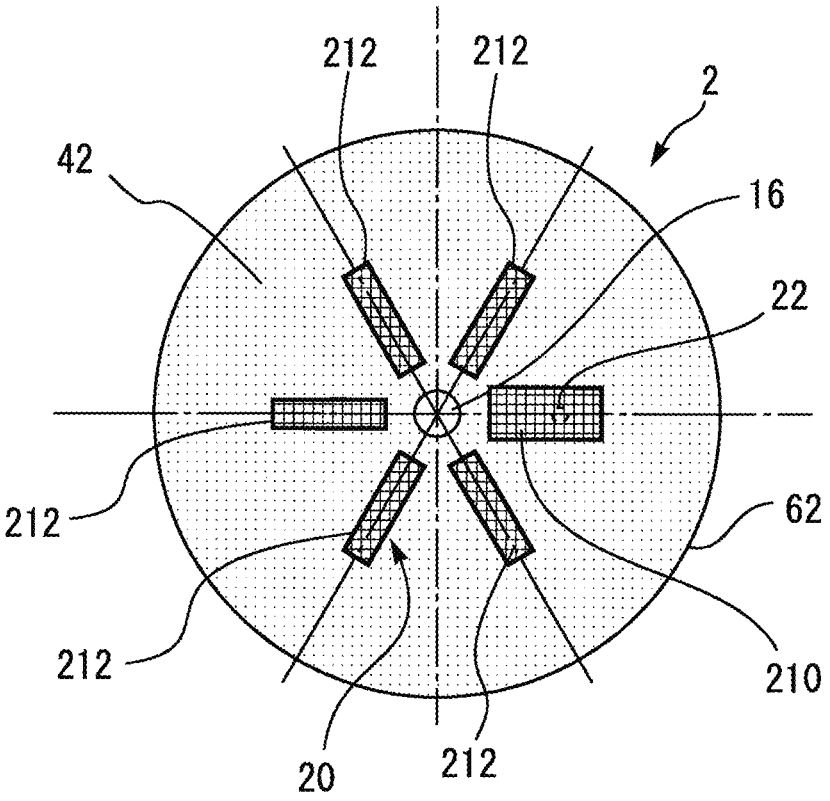
FIG. 15 is a schematic perspective view of an internal structure of a combustion chamber of an engine according to the fourth embodiment from the lower surface side.

FIG. 15 is a schematic perspective view of an internal structure of a combustion chamber of an engine according to the fourth embodiment from the lower surface side. In FIG. 15, elements shared with those in FIG. 1 are denoted by the same reference numerals, and detailed description thereof is omitted.

As shown in FIG. 15, in the engine 2 according to the fourth embodiment, one of the plurality of ducts 20 is configured as a large diameter duct 210 having a large inner diameter, and the other ducts 20 are configured as a small diameter duct 212 having a smaller inner diameter than the large diameter duct 210. The glow plug 22 is provided corresponding to the large diameter duct 210.

4-2. Features of Fourth Embodiment

The larger the duct inner diameter, the smaller the effect of extending the ignition position. Therefore, the large diameter duct 210 has higher ignition performance in the cold state of the engine 2 as compared with the small diameter duct 212. According to the engine 2 of the fourth embodiment, since the glow plug 22 is provided corresponding to the large diameter duct 210, the ignitability of the large diameter duct 210 may be further improved. As a result, simultaneous formation of the spray in which the ignition position is extended by passing through the small diameter duct 212 and the spray in which the ignitability is improved by passing through the large diameter duct 210 is possible, and therefore, both suppression of smoke and improvement of the ignitability may be achieved.

4-3. Modification of Fourth Embodiment

The engine 2 of the fourth embodiment may adopt a modified form as described below.

A plurality of large diameter ducts 210 may be provided. In this case, the glow plug 22 may be provided corresponding to at least one of the plurality of large diameter ducts 210.

The large diameter duct 210 and the small diameter duct 212 may be configured as through holes formed inside the cylinder head 4.

The large diameter duct 210 of the fourth embodiment may further have a configuration as the second duct 207 of the third embodiment.

5. Fifth Embodiment

Fifth embodiment will be described with reference to the drawings.

5-1. Configuration of Fifth Embodiment

Figure 16:
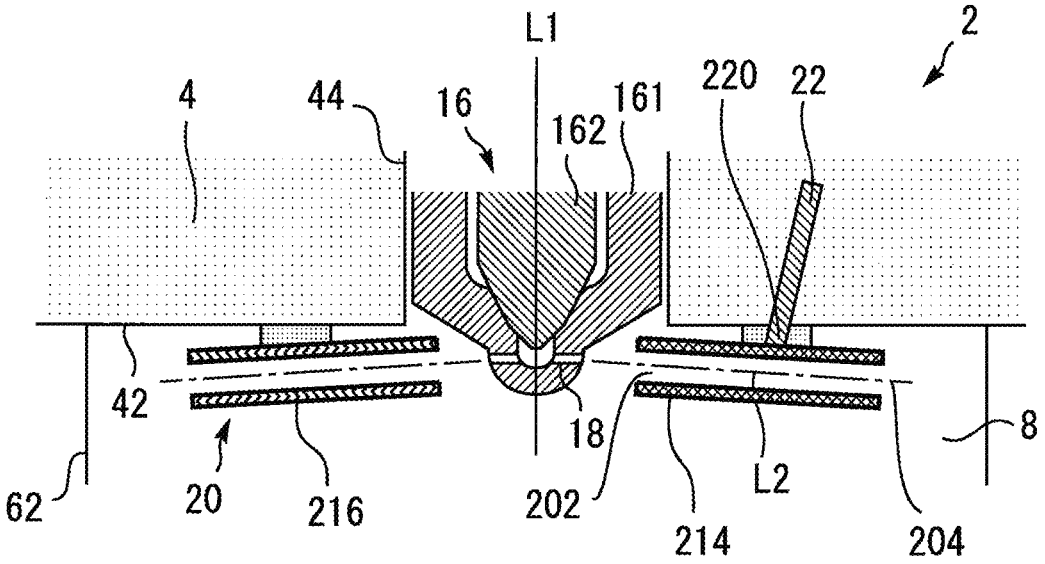
FIG. 16 is a schematic perspective view of an internal structure of a combustion chamber of an engine according to the fifth embodiment from the side surface side.

FIG. 16 is a schematic perspective view of an internal structure of a combustion chamber of an engine according to the fifth embodiment from the side surface side. In FIG. 16, elements shared with those in FIG. 1 are denoted by the same reference numerals, and detailed description thereof is omitted.

As shown in FIG. 16, in the engine 2 according to the fifth embodiment, one of the plurality of ducts 20 is configured as a high thermal conductivity duct 214 formed of a material having a high thermal conductivity, and the other ducts 20 are configured as a low thermal conductivity duct 216 formed of a material having a lower thermal conductivity than the high thermal conductivity duct 214. The glow plug 22 is provided corresponding to the high thermal conductivity duct 214. As a material of the high thermal conductivity duct 214, for example, aluminum may be used. As a material of the low thermal conductivity duct 216, for example, chromium steel or stainless steel may be used.

5-2. Features of Fifth Embodiment

The high thermal conductivity duct 214 has higher ignition performance in the cold state of the engine 2 as compared with the low thermal conductivity duct 216. According to the engine 2 of the fifth embodiment, since the glow plug 22 is provided corresponding to the high thermal conductivity duct 214, the ignitability of the high thermal conductivity duct 214 may be further improved. As a result, simultaneous formation of spraying in which the ignition position is extended by passing through the low thermal conductivity duct 216 and spraying in which the ignitability is improved by passing through the high thermal conductivity duct 214 is possible, and therefore, both suppression of smoke and improvement of ignitability may be achieved.

5-3. Modification of Fifth Embodiment

The engine 2 of the fifth embodiment may adopt a modified form as described below.

A plurality of high thermal conductivity ducts 214 may be provided. In this case, the glow plug 22 may be provided corresponding to at least one of the plurality of high thermal conductivity ducts 214.

Figure 17:
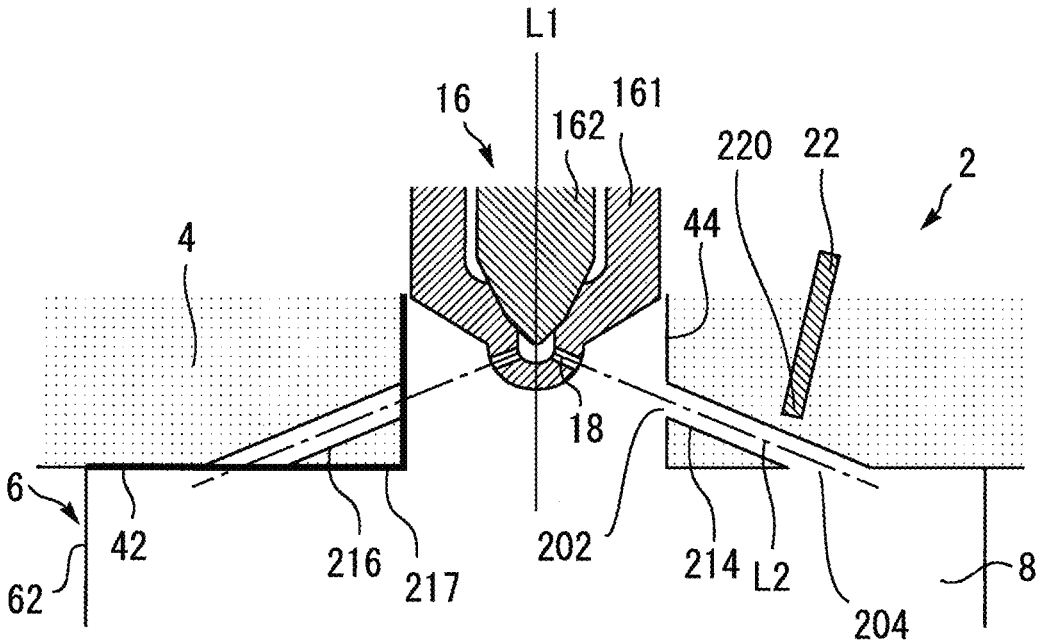
FIG. 17 is a schematic perspective view of an internal structure of an engine as a modification of the fifth embodiment from the side surface side.

The high thermal conductivity duct 214 and the low thermal conductivity duct 216 may be configured as through holes formed in the interior of the cylinder head 4. FIG. 17 is a schematic perspective view of an internal structure of an engine as a modification of the fifth embodiment from the side surface side. As shown in FIG. 17, the high thermal conductivity duct 214 and the low thermal conductivity duct 216 are configured as through holes inside the cylinder head 4. The cylinder head 4 is made of aluminum, which is a high thermal conductivity member. The side surfaces of the top surface portion 42 and the mounting hole 44 of the cylinder head 4 around the low thermal conductivity duct 216 are covered with a surface treatment layer 217 formed of chromium steel, which is a low thermal conductivity member. Such a configuration may also form the high thermal conductivity duct 214 and the low thermal conductivity duct 216.

The engine 2 of fifth embodiment may be configured in combination with the configuration of any one of embodiments 1 to 4.

6. Sixth Embodiment

Sixth embodiment will be described with reference to the drawings.

6-1. Configuration of Sixth Embodiment

Figure 18:
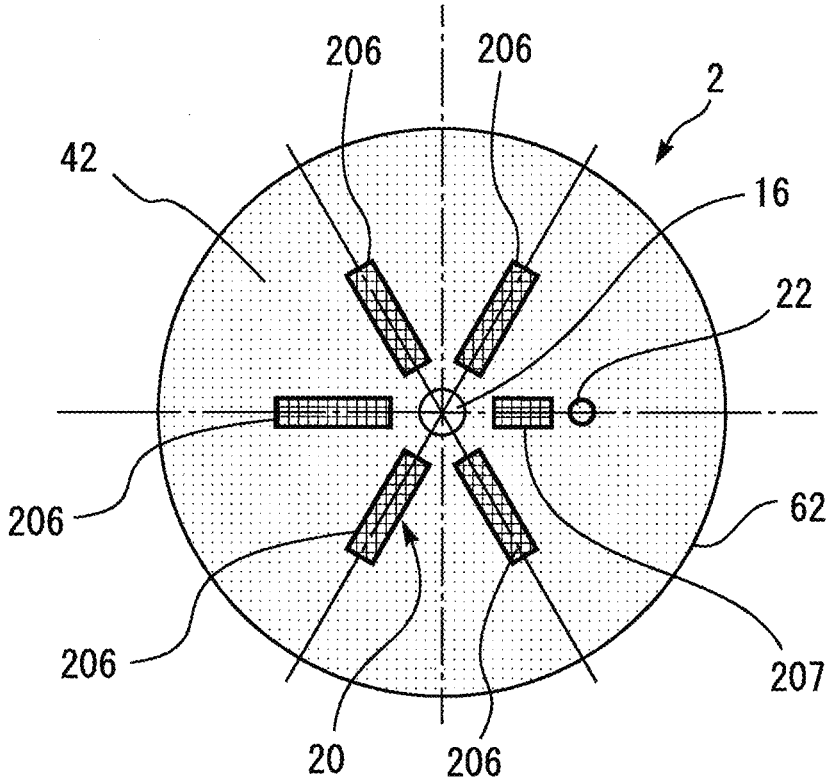
FIG. 18 is a schematic perspective view of an internal structure of a combustion chamber of an engine according to the sixth embodiment from the lower surface side.

FIG. 18 is a schematic perspective view of an internal structure of a combustion chamber of an engine according to the sixth embodiment from the lower surface side. In FIG. 18, elements shared with those in FIG. 13 are denoted by the same reference numerals, and detailed description thereof is omitted.

As shown in FIG. 18, in the engine 2 according to the sixth embodiment, one of the plurality of ducts 20 is configured as the second duct 207 having a shorter duct length, and the other duct 20 is configured as the first duct 206 having a longer duct length than the second duct 207. The glow plug 22 is exposed to the combustion chamber on the downstream side of the second duct 207.

6-2. Features of Sixth Embodiment

The shorter the duct length, the smaller the effect of extending the ignition position. Therefore, the second duct 207 has a higher ignition performance in the cold state of the engine 2 as compared with the first duct 206. That is, the first duct 206 corresponds to a low-ignitability duct, and the second duct 207 corresponds to a high-ignitability duct having higher ignitability than the first duct 206. According to the engine 2 of the sixth embodiment, since the fuel spray that has passed through the second duct 207, which is a highly ignitable duct, may be heated by the glow plug 22, the ignitability of the fuel spray that has passed through the second duct 207 may be further improved. Thereby, simultaneous formation of spraying in which the ignition position is extended by passing through the first duct 206 and spraying in which the ignitability is improved by passing through the second duct 207 is possible, so that both suppression of smoke and improvement of ignitability may be achieved.

6-3. Modification of Sixth Embodiment

The engine 2 of the sixth embodiment may adopt a modified form as described below.

A plurality of second ducts 207 may be provided. In this case, the glow plug 22 may be provided corresponding to at least one of the plurality of second ducts 207.

Figure 19:
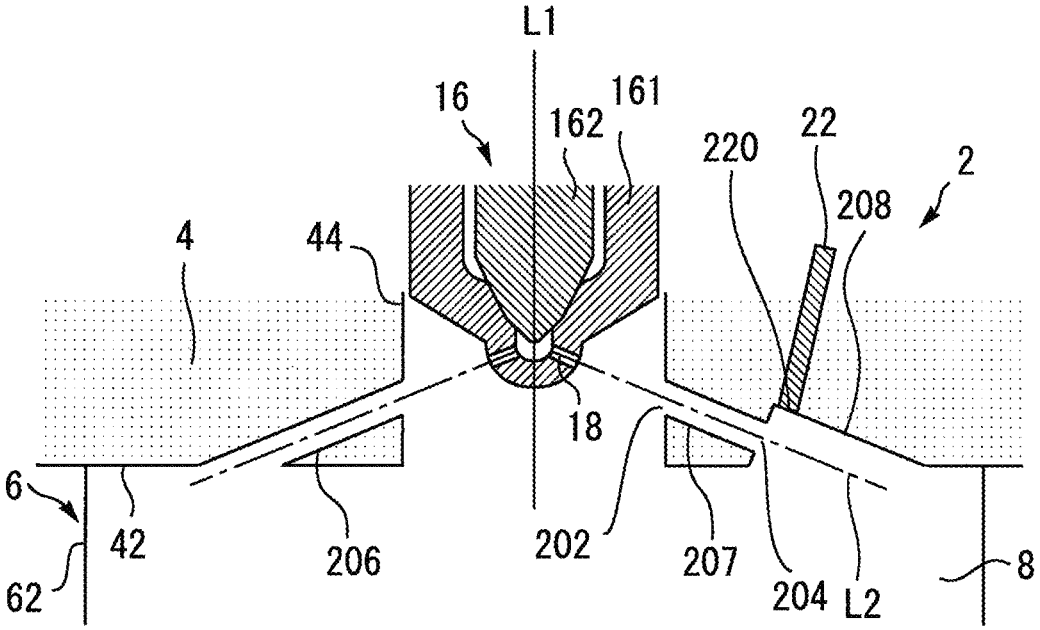
FIG. 19 is a schematic perspective view of the internal structure of an engine as a modification of the sixth embodiment from the side surface side.

The second duct 207 and the first duct 206 may be configured as a through hole formed inside the cylinder head 4. FIG. 19 is a schematic perspective view of the internal structure of an engine as a modification of the sixth embodiment from the side surface side. As shown in FIG. 19, the second duct 207 and the first duct 206 are configured as through holes in the interior of the cylinder head 4. The second duct 207 has a shorter duct length than the first duct 206 by processing the counterbore 208 from the top surface portion 42 side. The tip portion 220 of the glow plug 22 is disposed so as to be exposed to the outlet 204 of the second duct 207. According to such a configuration, the second duct 207 and the first duct 206 may also be formed.

Figure 20:
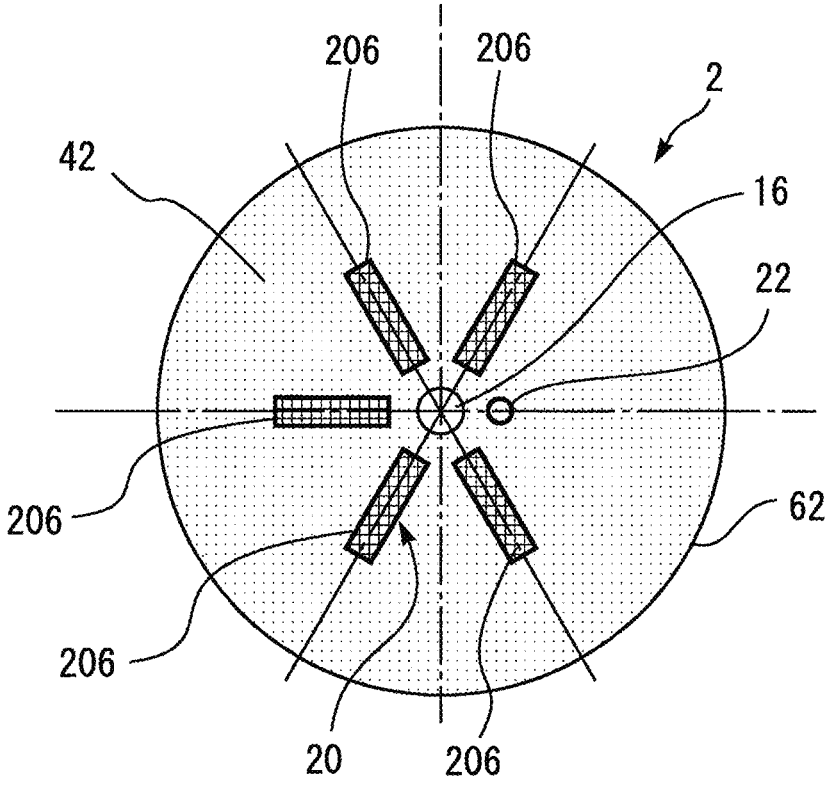
FIG. 20 is a schematic perspective view of an internal structure of a combustion chamber of an engine as a modification of the sixth embodiment from the bottom surface side.

The engine 2 of the sixth embodiment may have a configuration in which the second duct 207 is not provided. FIG. 20 is a schematic perspective view of an internal structure of a combustion chamber of an engine as a modification of the sixth embodiment from the bottom surface side. In FIG. 20, elements shared with those in FIG. 18 are denoted by the same reference numerals, and detailed description thereof is omitted.

As shown in FIG. 20, in the engine 2 according to the modification of the sixth embodiment, the second duct 207 is not arranged. The glow plug 22 is provided so as to be exposed to the fuel spray from the injection hole in which the second duct 207 is not disposed.

The fuel spray that does not pass through the duct has a higher ignition performance in the cold state of the engine 2 as compared with the fuel spray that passes through the duct. According to the engine 2 described in the modification of the sixth embodiment, since the fuel spray that does not pass through the duct may be heated by the glow plug 22, the ignitability may be improved. As a result, it is possible to simultaneously form the spray in which the ignition position is extended by passing through the first duct 206 and the spray in which the ignitability is improved without passing through the duct, so that both suppression of smoke and improvement of the ignitability may be achieved.

7. Seventh Embodiment

Seventh embodiment will be described with reference to the drawings.

7-1. Configuration of Seventh Embodiment

Figure 21:
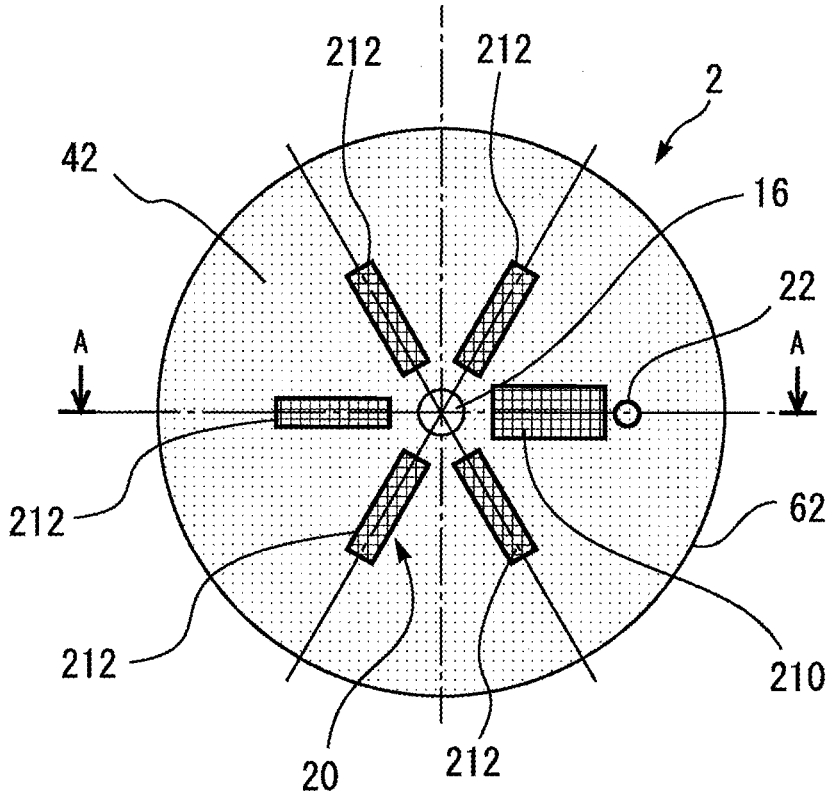
FIG. 21 is a schematic perspective view of an internal structure of a combustion chamber of an engine according to seventh embodiment from the lower surface side.

FIG. 21 is a schematic perspective view of an internal structure of a combustion chamber of an engine according to seventh embodiment from the lower surface side. In FIG. 21, elements shared with those in FIG. 15 are denoted by the same reference numerals, and detailed description thereof is omitted.

As shown in FIG. 21, in the engine 2 according to the seventh embodiment, one of the plurality of ducts 20 is configured as the large diameter duct 210 having a large inner diameter, and the other ducts 20 are configured as the small diameter duct 212 having a smaller inner diameter than the large diameter duct 210. The glow plug 22 is provided so as to be exposed to the fuel spray injected from the outlet 204 of the large diameter duct 210.

7-2. Features of Seventh Embodiment

The larger the duct inner diameter, the smaller the effect of extending the ignition position. Therefore, the large diameter duct 210 has higher ignition performance in the cold state of the engine 2 as compared with the small diameter duct 212. In other words, the small diameter duct 212 corresponds to a low-ignitability duct, and the large diameter duct 210 corresponds to a high-ignitability duct having higher ignition performance than the small diameter duct 212. According to the engine 2 of the seventh embodiment, since the fuel spray that has passed through the large diameter duct 210, which is a highly ignitable duct, may be heated by the glow plug 22, the ignitability of the fuel spray that has passed through the large diameter duct 210 may be further improved. As a result, simultaneous formation of the spray in which the ignition position is extended by passing through the small diameter duct 212 and the spray in which the ignitability is improved by passing through the large diameter duct 210 is possible, and therefore, both suppression of smoke and improvement of the ignitability may be achieved.

7-3. Modification of Seventh Embodiment

The engine 2 of the seventh embodiment may adopt a modified form as described below.

A plurality of large diameter ducts 210 may be provided. In this case, the glow plug 22 may be provided corresponding to at least one of the plurality of large diameter ducts 210.

The large diameter duct 210 and the small diameter duct 212 may be configured as through holes formed inside the cylinder head 4.

The engine 2 of the seventh embodiment may be configured in combination with the configuration of the engine of the sixth embodiment.

8. Eighth Embodiment

Eighth embodiment will be described with reference to the drawings.

8-1. Configuration of Eighth Embodiment

Figure 22:
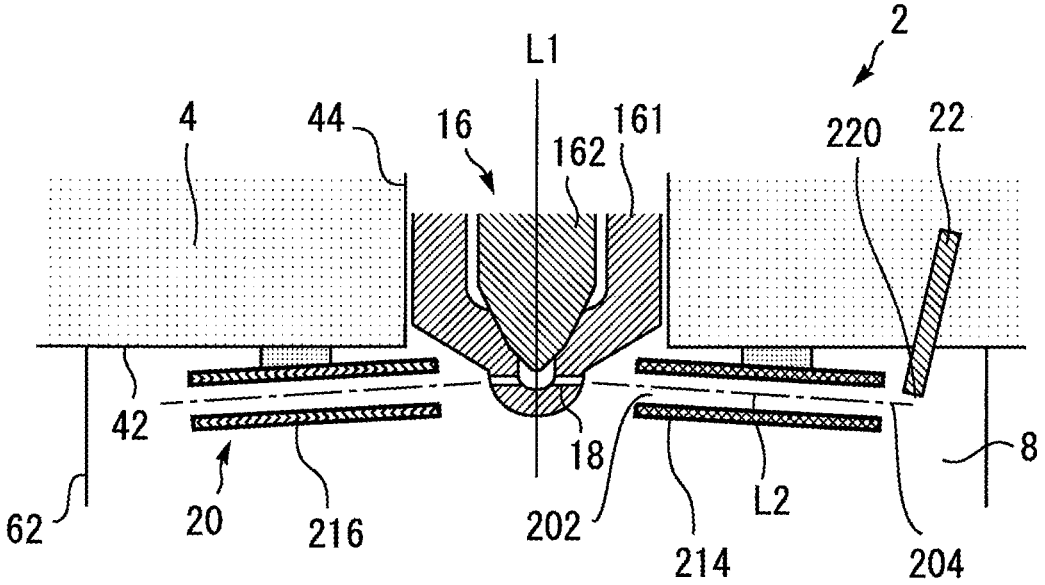
FIG. 22 is a schematic perspective view of an internal structure of a combustion chamber of an engine according to the eighth embodiment from the side surface side.

FIG. 22 is a schematic perspective view of an internal structure of a combustion chamber of an engine according to the eighth embodiment from the side surface side. In FIG. 22, elements shared with those in FIG. 16 are denoted by the same reference numerals, and detailed description thereof is omitted.

As shown in FIG. 22, in the engine 2 according to the eighth embodiment, one of the plurality of ducts 20 is configured as the high thermal conductivity duct 214 formed of a material having a high thermal conductivity, and the other ducts 20 are configured as the low thermal conductivity duct 216 formed of a material having a lower thermal conductivity than the high thermal conductivity duct 214. The glow plug 22 is provided so as to be exposed to the fuel spray injected from the outlet 204 of the high thermal conductivity duct 214.

8-2. Features of Eighth Embodiment

The high thermal conductivity duct 214 has higher ignition performance in the cold state of the engine 2 as compared with the low thermal conductivity duct 216. That is, the low thermal conductivity duct 216 corresponds to a low-ignitability duct, and the high thermal conductivity duct 214 corresponds to a high-ignitability duct having higher ignition performance than the low thermal conductivity duct 216. According to the engine 2 of the eighth embodiment, since the glow plug 22 may heat the fuel spray that has passed through the high thermal conductivity duct 214, which is a high-ignitability duct, by the glow plug 22, the ignitability of the fuel spray that has passed through the high thermal conductivity duct 214 may be further improved. As a result, simultaneous formation of spraying in which the ignition position is extended by passing through the low thermal conductivity duct 216 and spraying in which the ignitability is improved by passing through the high thermal conductivity duct 214 is possible, and therefore, both suppression of smoke and improvement of ignitability may be achieved.

8-3. Modification of Eighth Embodiment

The engine 2 of the eighth embodiment may adopt a modified form as described below.

A plurality of high thermal conductivity ducts 214 may be provided. In this case, the glow plug 22 may be provided corresponding to at least one of the plurality of high thermal conductivity ducts 214. The high thermal conductivity duct 214 and the low thermal conductivity duct 216 may be configured as through holes formed inside the cylinder head 4. In this case, the cylinder head 4 may be made of aluminum, which is a high thermal conductivity member, and the side surfaces of the top surface portion 42 and the mounting hole 44 of the cylinder head 4 around the low thermal conductivity duct 216 may be covered with a surface treatment layer formed of chromium steel, which is a low thermal conductivity member. Such a configuration may also form the high thermal conductivity duct 214 and the low thermal conductivity duct 216.

The engine 2 of the eighth embodiment may be configured in combination with the configuration of the engine of the sixth or seventh embodiment.

What is claimed is:

1. A compressed self-ignition type internal combustion engine configured to perform combustion by injecting fuel into a compressed combustion chamber, the internal combustion engine comprising:

a fuel injection nozzle having a plurality of injection holes for injecting fuel, the plurality of injection holes being provided so as to be exposed from a cylinder head of the internal combustion engine to the combustion chamber; and a hollow duct provided so that an inlet and an outlet are exposed to the combustion chamber and fuel spray injected from one of the injection holes of the fuel injection nozzle passes from the inlet to the outlet, wherein the plurality of injection holes are provided so that each fuel spray is injected radially toward a bore wall surface of the combustion chamber, wherein the duct is disposed corresponding to one of the plurality of injection holes, and wherein the internal combustion engine includes a heating device for heating a fuel spray injected from an injection hole in which the duct is not arranged among the plurality of injection holes.

2. A compressed self-ignition type internal combustion engine configured to perform combustion by injecting fuel into a compressed combustion chamber, the internal combustion engine comprising:

a fuel injection nozzle having a plurality of injection holes for injecting fuel, the plurality of injection holes being provided so as to be exposed from a cylinder head of the internal combustion engine to the combustion chamber; and a plurality of hollow ducts configured so that inlets and outlets are exposed to the combustion chamber, wherein the plurality of ducts are configured such that each fuel spray injected from the plurality of injection holes of the fuel injection nozzle passes from the inlet to the outlet, and wherein the internal combustion engine comprises a heating device for heating at least one of the plurality of ducts, without heating at least another one of the plurality of ducts, wherein the plurality of hollow ducts are inside the cylinder head, wherein the plurality of ducts includes:

a low thermal conductivity duct, and a high thermal conductivity duct having a higher thermal conductivity than the low thermal conductivity duct, and wherein the heating device is configured to heat the high thermal conductivity duct, without heating the low thermal conductivity duct, wherein the cylinder head comprises:

first and second surface portions where the outlet and inlet of the low thermal conductivity duct are located, and third and fourth surface portions where the outlet and inlet of the high thermal conductivity duct are located, and wherein a surface treatment layer covers the first and second surface portions, without covering the third and fourth surface portions.

3. The internal combustion engine according to claim 2, wherein the surface treatment layer has a thermal conductivity lower than the cylinder head.

4. The internal combustion engine according to claim 2, wherein the first and third surface portions are portions of a top surface portion of the cylinder head forming the combustion chamber, and wherein the second and fourth surface portions are portions of a mounting hole which passes through the top surface portion and in which the fuel injection nozzle is mounted.

* * * * *